US006149252A

United States Patent [19]

Browning

[11] Patent Number: 6,149,252

[45] Date of Patent: Nov. 21, 2000

[54] GLOVE BOX FOR CUTTING A HOLE IN A CEILING

[76] Inventor: Thomas D. Browning, 1222 Virginia Ave., Norton, Va. 24273

[21] Appl. No.: 09/325,754

[22] Filed: Jun. 4, 1999

[51] Int. Cl.[7] ..... B08B 15/02

[52] U.S. Cl. ..... 312/1; 134/200; 15/301

[58] Field of Search ..... 312/1, 3, 4, 5, 312/6; 134/200, 201; 15/227, 257.1, 301

[56] References Cited

U.S. PATENT DOCUMENTS

| | | | |
|---|---|---|---|
| 2,372,073 | 3/1945 | Flournoy . | |
| 3,858,418 | 1/1975 | Butler | 312/1 X |
| 4,339,048 | 7/1982 | McMillen et al. . | |
| 4,626,291 | 12/1986 | Natale | 15/227 X |
| 4,736,488 | 4/1988 | Nielsen . | |
| 4,765,352 | 8/1988 | Strieter . | |
| 4,865,401 | 9/1989 | Jacobson | 312/1 |
| 4,911,191 | 3/1990 | Bain | 312/1 X |
| 4,923,251 | 5/1990 | Funakawa et al. . | |
| 4,955,984 | 9/1990 | Cuevas . | |
| 5,062,871 | 11/1991 | Lemon, III . | |
| 5,088,511 | 2/1992 | Bain | 312/1 X |
| 5,464,286 | 11/1995 | Stevens et al. . | |
| 5,824,161 | 10/1998 | Atkinson | 312/3 X |

FOREIGN PATENT DOCUMENTS

WO 88/04964 7/1988 WIPO .

*Primary Examiner*—Anthony D. Barfield
*Assistant Examiner*—Michael J. Fisher
*Attorney, Agent, or Firm*—Richard C. Litman

[57] ABSTRACT

A glove box for cutting a hole in a ceiling collects dust and debris during the cutting operation. The glove box is a transparent container having a central aperture in the bottom. The aperture includes an inwardly extending ring having an outwardly extending flange for attaching a glove. A seal at the top of the container engages the ceiling, compressing to accommodate irregularities or minor slope in the ceiling. The glove box may be held by the user during use, or may be supported on top of a telescoping pole. A fork engages the telescoping pole at its lower end, and opposite sides of the cylinder on its upper end. A spring between the fork and telescoping pole biases the container towards the ceiling. The container may include openings for a vacuum hose or an electrical cord for a cutting tool.

17 Claims, 10 Drawing Sheets

GLOVE BOX FOR CUTTING A HOLE IN A CEILING

BACKGROUND OF THE INVENTION

1. Field of the Invention

The present invention relates to glove boxes. Specifically, the invention is a glove box for cutting a hole in a ceiling, supported on a telescoping pole.

2. Description of the Related Art

Those who perform construction, plumbing, electrical, insulation, asbestos removal, or other dust-producing work inside homes and businesses have frequently sought to reduce the amount of dust and debris produced by those activities. In some cases, such as asbestos removal, the dust must be completely contained to prevent health hazards. In other situations, the workers merely wish to avoid spreading debris throughout the work site, thereby providing a better service to the building's occupants. It therefore comes as no surprise that several other dust containment systems have been proposed.

Several dust containment systems described in various patents require the user to partially enter the containment area, thereby significantly reducing the level of convenience and health benefits for the user. Additionally, it may be difficult to keep all of the dust and debris within the containment area during the entry and exit of workers. Other dust containment systems rely on a bag type container, making it difficult for such containers to support larger or heavier pieces of debris. Still other dust containment systems support the container against a surface using a cantilever-type frame, reducing the ability of the container to seal against the surface.

One example of a glove device used to keep a work area clean is U.S. Pat. No. 4,736,488, issued to Ruth A. Nielsen on Apr. 12, 1988, describing a paint drip pan having an aperture for receiving the user's wrist, and a glove attached within the aperture.

U.S. Pat. No. 4,765,352, issued to Jerome P. Strieter on Aug. 23, 1988, describes an isolation enclosure for cleaning contaminated environments. The enclosure includes a booth and an adjustable ceiling-contacting plenum. A vacuum and ventilation system is used to filter contaminants, such as asbestos particles, from the air within the enclosure.

U.S. Pat. No. 4,865,401, issued to Earl B. Jacobson on Sep. 12, 1989, describes a glove bag for removing asbestos brakes. The bag includes removable stiffening ribs forming a tapered shape. One end is covered by a pair of overlapping slotted membranes to fit over the brake. Opposing sides include gloves extending into the bag. The bag is supported on a telescoping pole. A similar invention is described in International Pat. App. No. WO 88/04964, published on Jul. 14, 1988.

U.S. Pat. No. 4,911,191, issued to G. William Bain on Mar. 27, 1990, describes an apparatus for protecting a ceiling work area from dispersal of asbestos fibers. The apparatus comprises a bag suspended from a horizontal frame, fitting against the ceiling. The frame is held against the ceiling by a telescoping pole supported by outrigger frames. The bag includes at least one glove extending into the bag. An exhaust fan maintains a pressure below atmospheric pressure within the bag. A similar invention is described in U.S. Pat. No. 5,088,511, issued to G. William Bain on Feb. 18, 1992.

U.S. Pat. No. 4,923,251, issued to Naoyoshi Funakawa et al. on May 8, 1990, describes an apparatus for removing asbestos from a surface. The apparatus comprises a rotary wire brush within a container configured to be positioned against a ceiling. A suction means draws air in from the outside of the container. The apparatus is mounted on a platform which can be moved horizontally during operation. The front of the container is slightly below the ceiling, preventing the container from scraping the asbestos off ahead of the wire brush, and allowing for air to enter the container and be drawn towards the suction means.

U.S. Pat. No. 4,955,984, issued to Levearn F. Cuevas on Sep. 11, 1990, describes a cylindrical debris catcher for drills, stud guns, etc. The debris catcher includes a connector end for connecting to the tool, a collector end configured to remain in contact with the work surface, and a bellows portion therebetween.

U.S. Pat. No. 5,002,871, issued to Walter B. Lemon III, on Nov. 5, 1991, describes a system for localizing a portion of a structure for treatment. The system includes a support frame with a debris containment bag. At least one glove extends into the bag. A hose for spraying liquids into the bag and a vacuum hose for exhausting gases from the bag also attach to the bag.

U.S. Pat. No. 5,464,286, issued to Sidney V. Stevens et al. on Nov. 7, 1995, describes a ceiling tile dust and debris catcher. The dust catcher is a generally cylindrical plastic bag attaching to a ceiling by adhesive tape, and is snugged around the waist of a worker by a drawstring.

Several different support poles have been proposed in U.S. patents. For example, U.S. Pat. No. 2,372,073, issued to Algernon F. Flournoy on Mar. 20, 1945, describes a harvesting basket supported on a pole. The lower end of the pole has a spike to facilitate driving the pole into the ground. Additionally, U.S. Pat. No. 4,339,048, issued to Bruce A. McMillen et al. on Jul. 13, 1982, describes an elevated garbage bag holder. The garbage bag holder includes an elevated platform for supporting the garbage and a stem. The stem is held by a receptacle mounted in the ground.

None of the above containment systems includes a transparent, rigid container pressed into sealing engagement with a work surface by a centrally mounted pole, and having a seal capable of accommodating small variations in the surface. None of the above inventions and patents, taken either singularly or in combination, is seen to describe the instant invention as claimed. Thus a glove box for cutting a hole in a ceiling solving the aforementioned problems is desired.

SUMMARY OF THE INVENTION

The invention is a glove box for collecting debris while cutting a hole in a ceiling. The glove box comprises a transparent cylinder having a glove extending inward from the bottom, and a telescoping support pole.

The transparent cylinder has an open top and a closed bottom. The bottom defines an aperture dimensioned and configured to receive a person's hand, wrist, and lower arm. A ring extends upward from the aperture, into the cylinder. The ring includes an outwardly extending flange along its top edge. The end of a long glove can be stretched around the flange, securing it in place. Securing the glove in this manner allows a right handed or left handed user to attach the appropriate glove, and also allows either rubber or cloth gloves to be selected.

The top of the cylinder mates with the ceiling or other surface to be cut. A resilient seal extends around the top, clipping to the top edge of the cylinder. The seal preferably extends a short distance above the upper edge of the cylinder, allowing it to compress to accommodate surface irregularities or minor deviations in surface angle. A reinforcement ring may extend around the top of the cylinder, below the seal.

The cylinder preferably includes a vacuum attachment aperture for a vacuum hose, and a power cord aperture for the electric power cord of the tool being used within the cylinder. Both the vacuum attachment and power cord aperture may be closed with caps when not in use, preventing debris from exiting through these openings. The power cord aperture preferably includes a rubber seal for engaging the cord, preventing debris from exiting when the cap is removed.

A pair of sleeves is attached to opposite sides of the cylinder, with the hollow interior portion extending vertically and opening at the bottom. The sleeves are dimensioned and configured to receive opposing prongs of a fork. Likewise, the stem of the fork is hollow, being dimensioned and configured to receive the top end of a telescoping pole. The hollow stem of the fork contains a spring for biasing the cylinder against the ceiling.

The telescoping pole may be any type, and several different variations are currently available commercially. Mating inner and outer members of the telescoping pole may, for example, be locked in place by a pivoting washer, a threaded clamp tightened over a split end on the outer member, a split clamping collar, or a clutch mechanism. The bottom of the telescoping pole includes a flat base for preventing the pole from tipping over, and for placement of the user's foot during adjustment.

In use, the user places the fork on top of the pole, places the vertical sleeves on the glove box over the prongs of the fork, and places a cutting tool inside the cylinder. If the tool is electric, the power cord is extended through the power cord aperture to allow it to be plugged into an electric outlet. The user may optionally connect a vacuum to the vacuum attachment. Next, the telescoping pole is extended upward until the seal is pressed against the ceiling. The user may now reach into the glove, grasp the tool, and cut the ceiling. The resulting dust and debris will fall into the cylinder and be contained therein, or, if the vacuum has been attached and activated, will be vacuumed out of the container. The upward pressure of the pole along the central axis of the cylinder helps keep all parts of the top edge against the ceiling.

If desired, or if the glove box is used to cut an angled ceiling or wall, the user may merely hold the glove box with his hand during cutting, without using the telescoping pole and fork.

Accordingly, it is a principal object of the invention to provide a glove box for containing the dust and debris resulting from cutting a ceiling or other surface.

It is another object of the invention to provide a glove box which may be used with or without a telescoping support pole.

It is a further object of the invention to provide a glove box capable of sealingly engaging surfaces with slight irregularities or slightly angled surfaces.

Still another object of the invention is to provide a glove box useable by right and left handed individuals.

An additional object of the invention is to provide a glove box having closeable openings for vacuum attachment or for the power cord of a tool.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
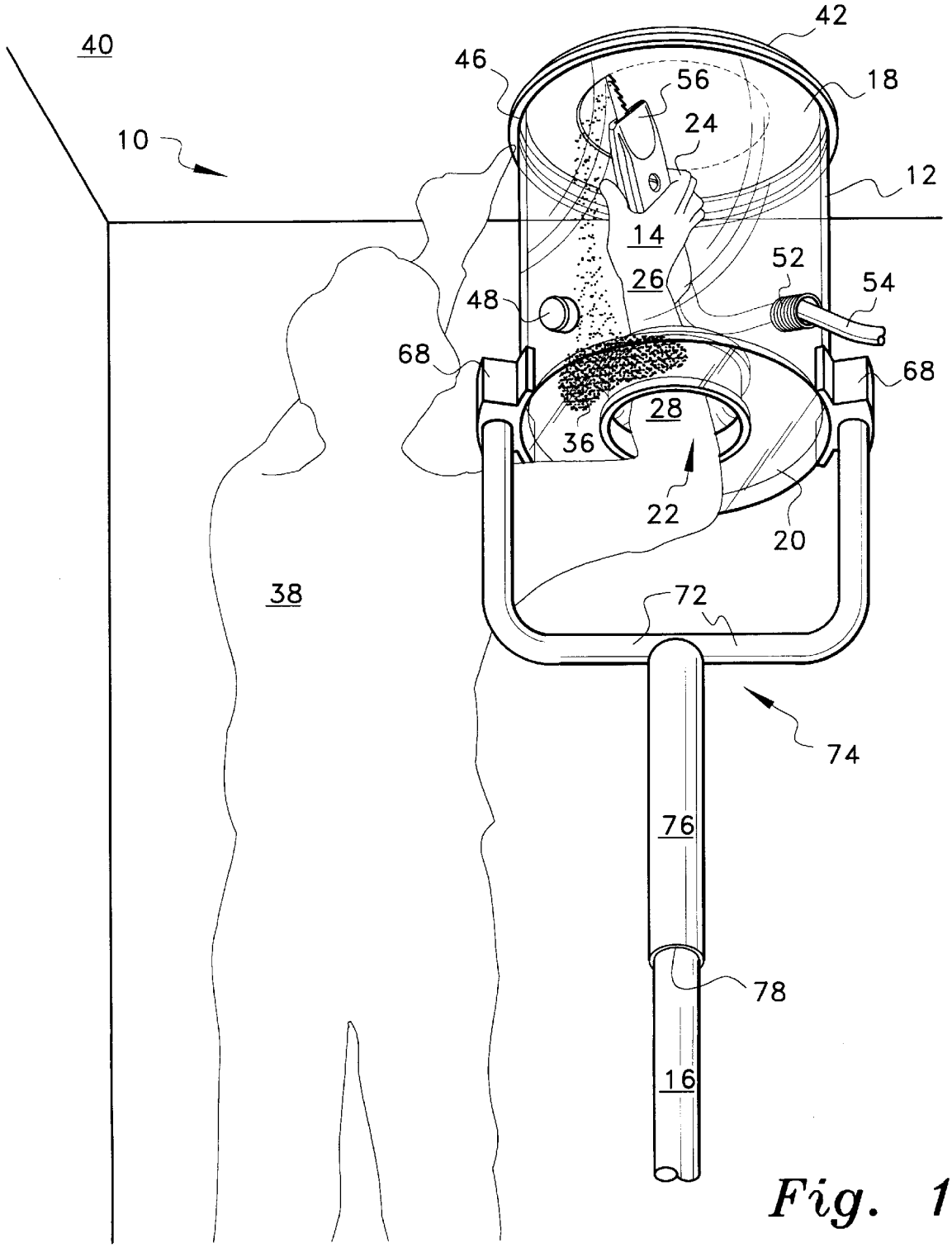
FIG. 1 is an environmental, perspective view of a glove box for cutting a hole in a ceiling according to the present invention, illustrated with its support pole in use.
Figure 2:
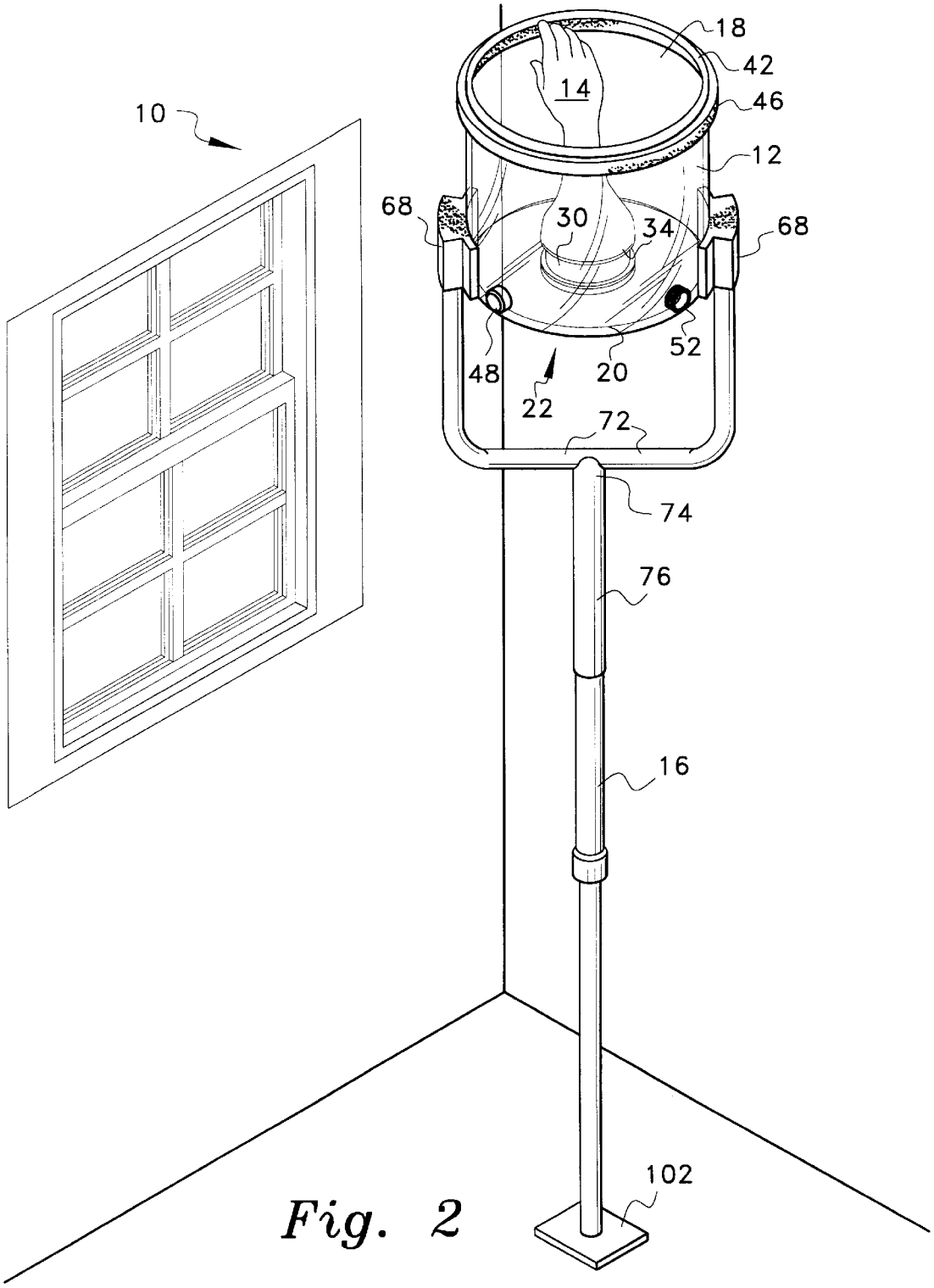
FIG. 2 is a perspective view of a glove box for cutting a hole in a ceiling according to the present invention.
Figure 3:
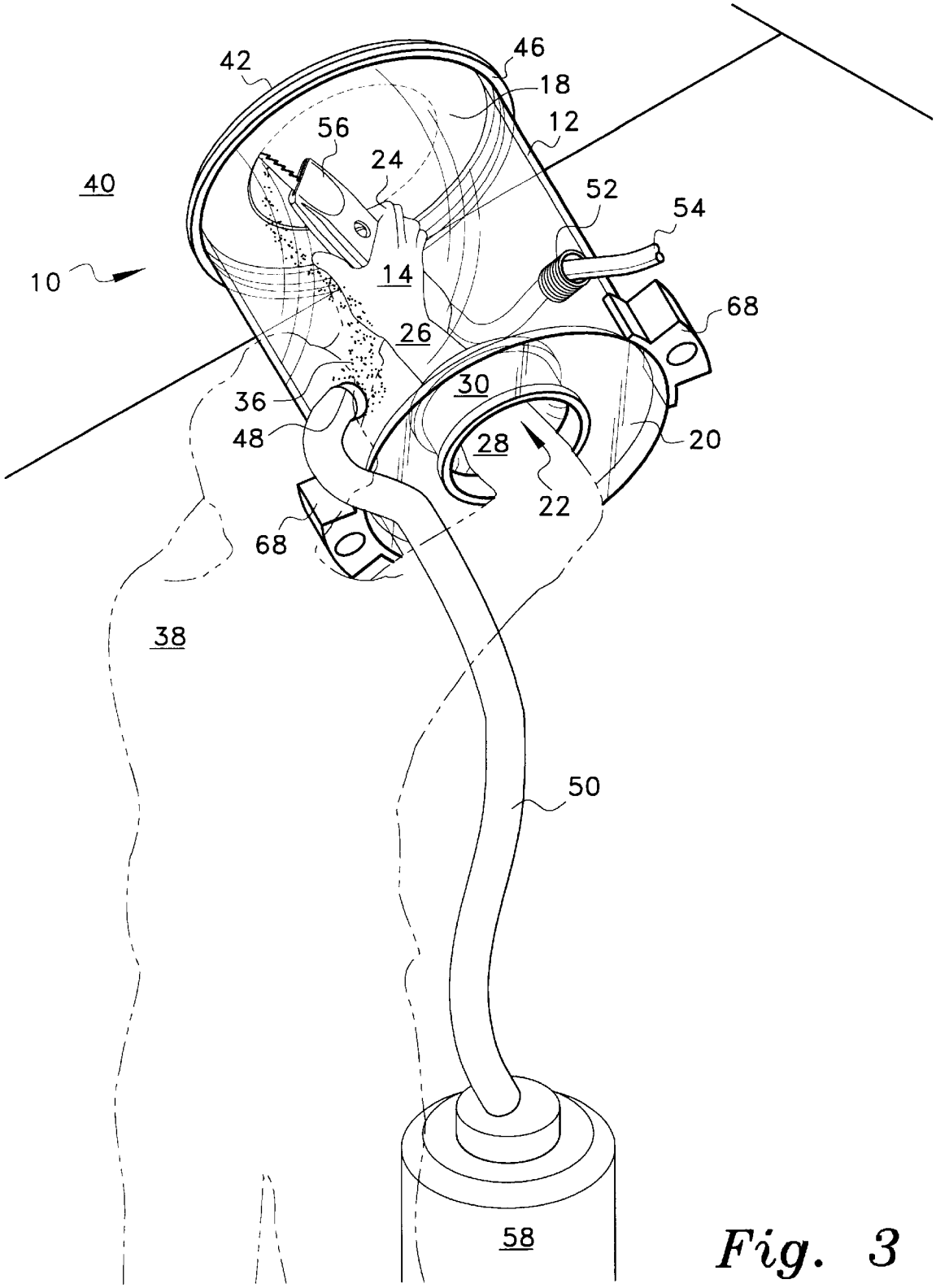
FIG. 3 is an environmental, perspective view of a glove box for cutting a hole in a ceiling according to the present invention, illustrated in use without the support pole.
Figure 4:
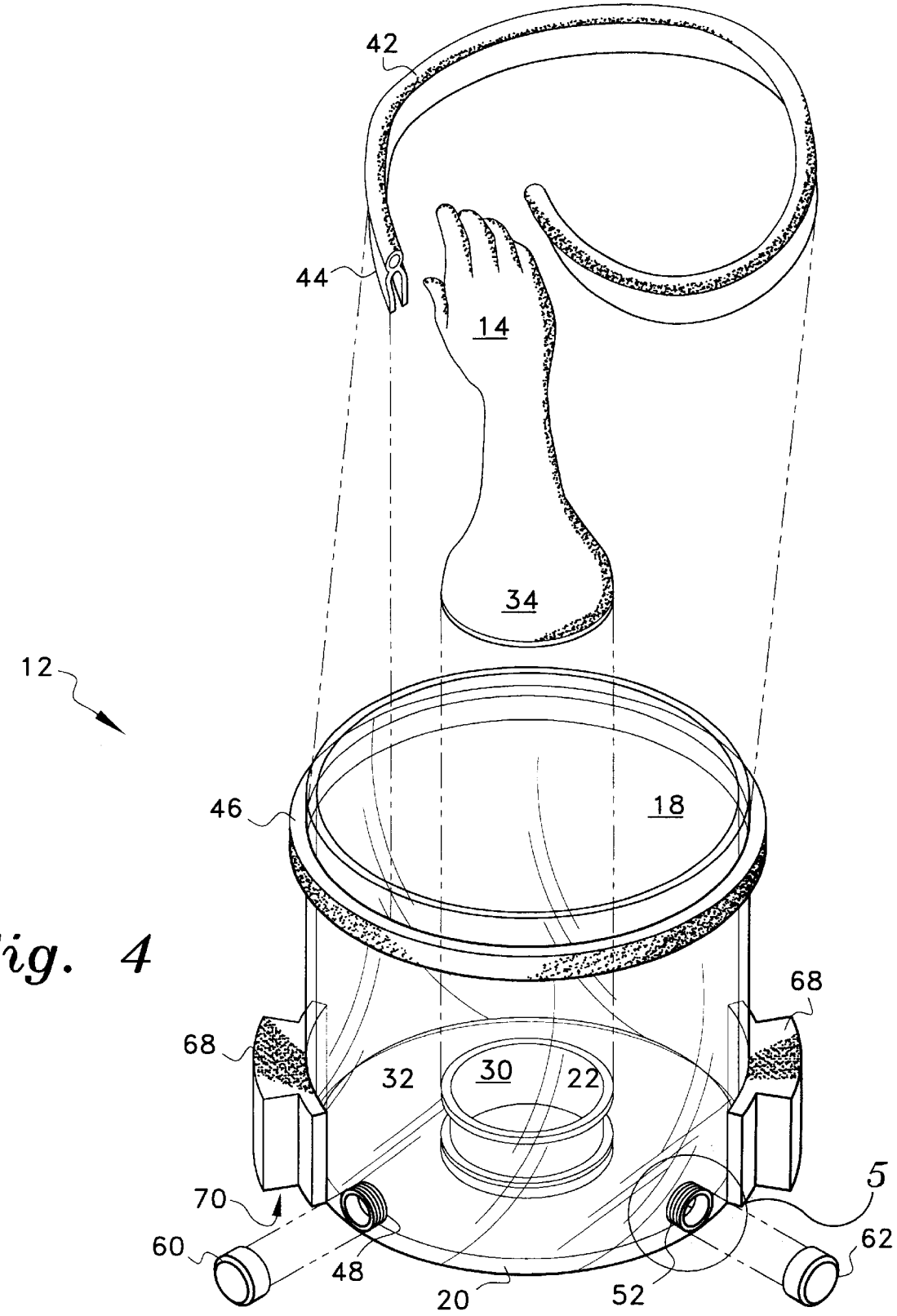
FIG. 4 is a perspective, partially exploded view of a glove box for cutting a hole in a ceiling according to the present invention.

The present invention is a glove box for collecting debris while cutting a hole in a ceiling. Referring to FIGS. 1–2, the glove box 10 comprises a rigid, transparent container 12, preferably in the form of a cylinder, having a glove 14 extending inward from the bottom 20, and a telescoping support pole 16.

Referring to FIGS. 1–4, the transparent container 12 has an open top 18 and a closed bottom 20. The bottom 20 defines an aperture 22 dimensioned and configured to receive a person's hand 24, wrist 26, and lower arm 28. The container 12 includes means for attaching a glove 14 around the aperture 22. Preferably, a ring 30 extends upward from the aperture 22, into the container 12. The ring 30 includes an outwardly extending flange 32 along its top edge. The end 34 of a long glove 14 can be stretched around the flange 32, securing the glove 14 in place, and preventing dust and debris 36 from exiting the container 12 through the aperture 22. Securing the glove 14 in this manner allows a right handed or left handed user to attach the appropriate glove 14, and also allows either rubber or cloth gloves 14 to be selected. The glove 14 must be sufficiently long to allow the user 38 to reach anywhere around the open top 18 of container 12.

The open top 18 of the container 12 mates with the ceiling 40 or other surface to be cut. A resilient seal 42 extends around the top. The seal 42 includes a clip 44 for securing the seal 42 to the top edge of the container 12. The seal 42 may thereby be removed and replaced as needed. The seal 42 preferably extends a short distance above the upper edge of the container, allowing it to compress to accommodate surface irregularities or minor deviations in surface angle. A reinforcement ring 46 may extend around the top of the cylinder 12, below the seal 42.

Figure 5:
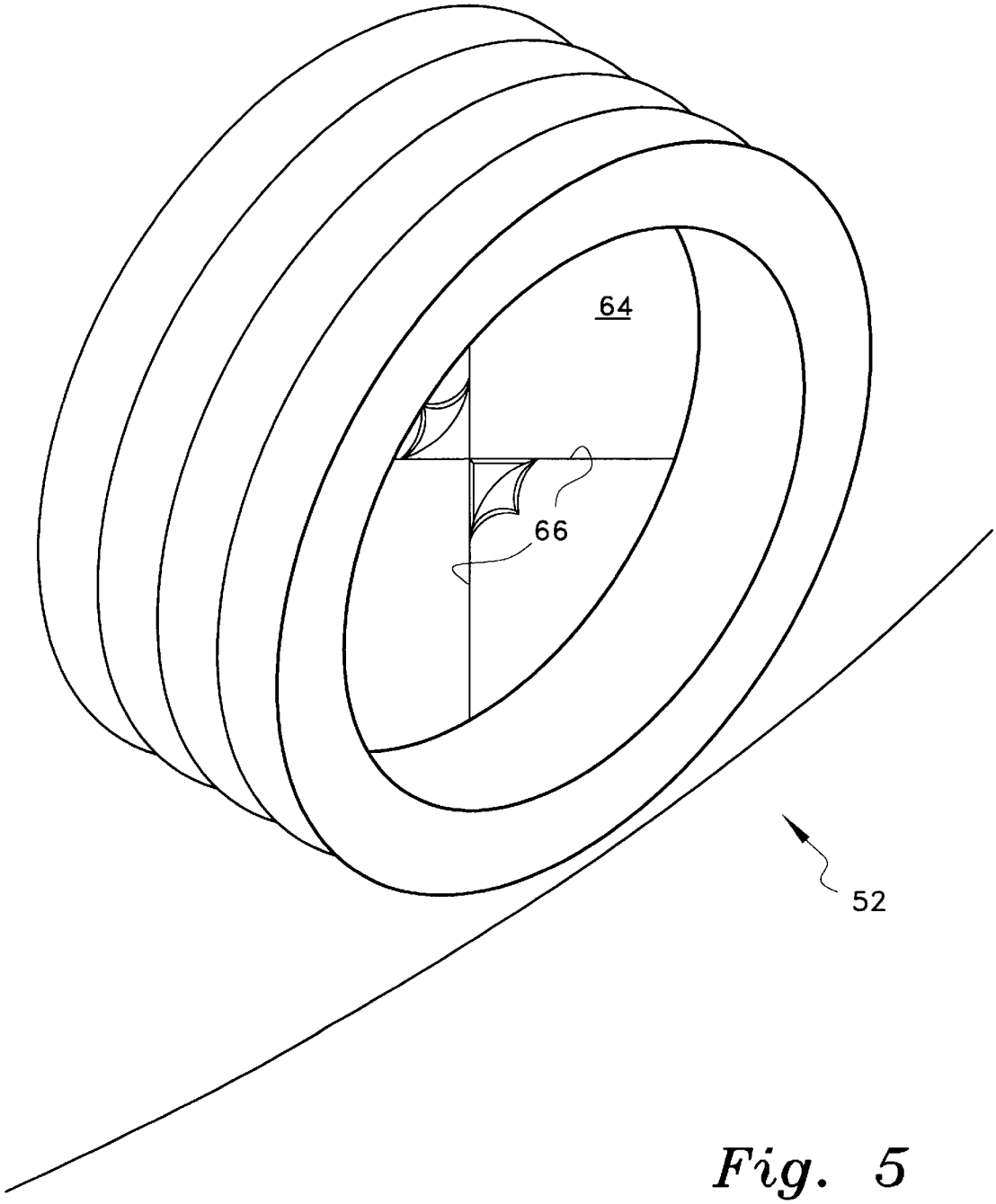
FIG. 5 is a sectional perspective view of the opening for an electrical cord in the circled area designated as 5 in FIG. 4.
Figure 6:
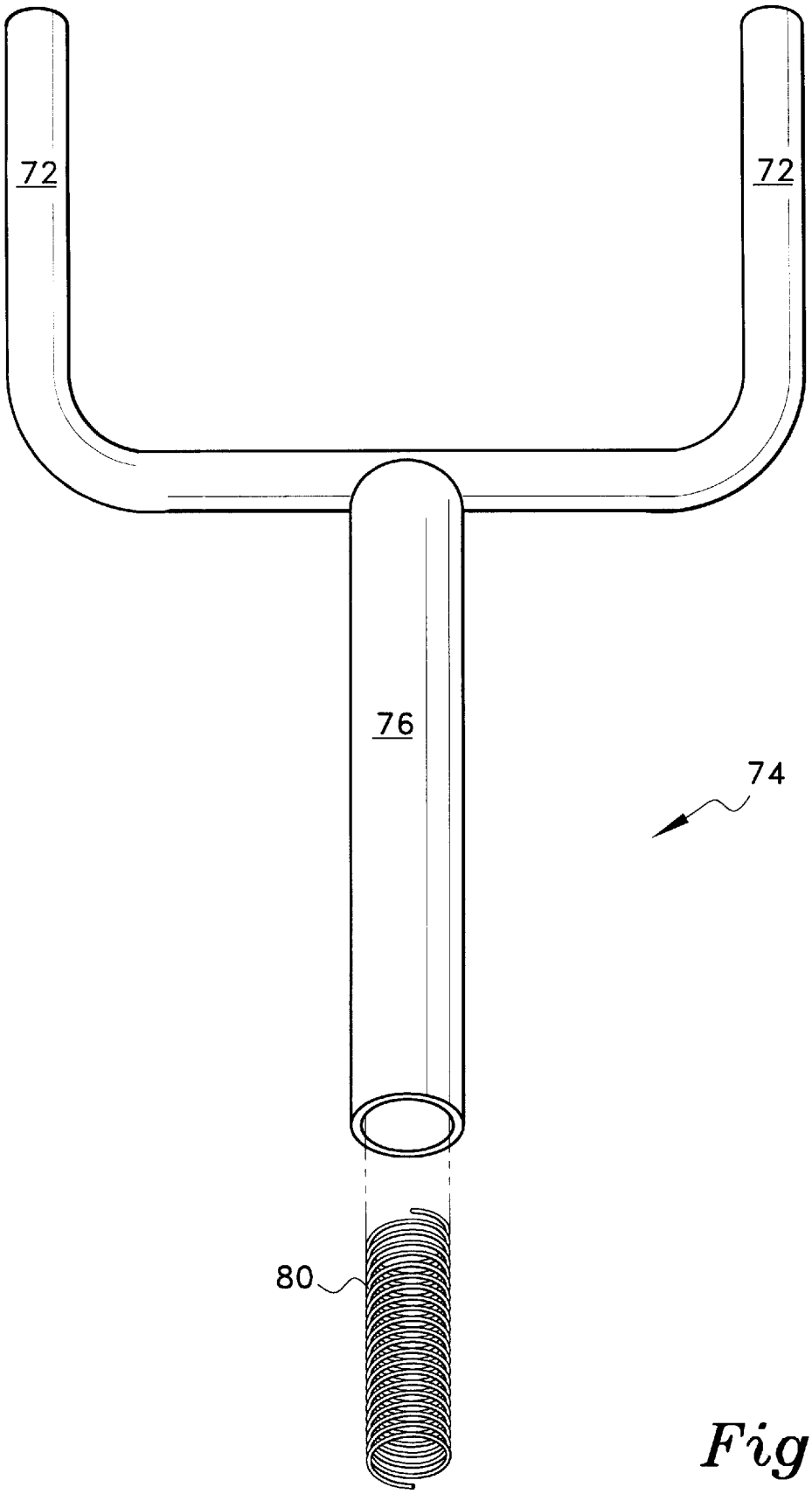
FIG. 6 is a perspective, partially exploded view of a fork for attaching a glove box to a telescoping support pole.

The container 12 preferably includes a vacuum attachment aperture 48, dimensioned and configured to receive a vacuum hose 50, so that a vacuum 58 may be used to collect debris 36 from the container 12. Additionally, the container 12 preferably includes a power cord aperture 52, dimensioned and configured to receive the electric power cord 54 of the tool 56 being used within the container 12. Both the vacuum attachment 48 and power cord aperture 52 may be closed with caps 60,62 when not in use, preventing debris 36 from exiting through these openings 48,52. Although internally threaded caps 60,62 mating with external threads on vacuum attachment 48 and power cord aperture 52 are illustrated, alternative means for fastening the caps 60,62 may be selected. As illustrated in FIG. 5, the power cord aperture 52 preferably includes a resilient seal 64 for engaging the cord, preventing debris from exiting when the cap is removed. The seal 64 preferably defines slits 66, permitting the plug portion (not illustrated) of a power cord 54 to pass through the seal 64, with the seal 64 then abutting the power cord 54.

Referring to FIGS. 1, 2, 4, and 6, A pair of sleeves 68 is located to opposite sides of the container 12, with the hollow interior portion 70 extending vertically and opening at the bottom. The prongs 72 of a fork 74 are dimensioned and configured to fit within the sleeves 68. Likewise, the stem 76 of the fork 74 is hollow, being dimensioned and configured to receive the top end 78 of a telescoping pole 16. The hollow stem 76 of the fork contains a spring 80 for biasing the container against the ceiling 40.

Figure 7A:
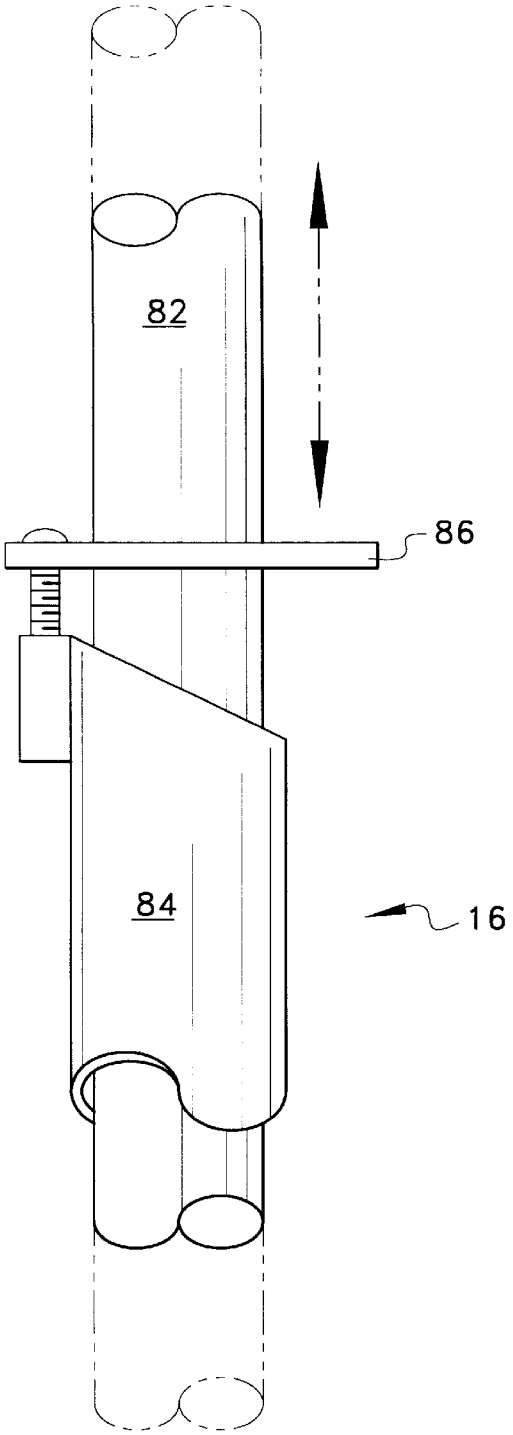
FIG. 7A is a sectional side view of a first embodiment of a telescoping support pole, showing the locking mechanism in the unlocked position.
Figure 7B:
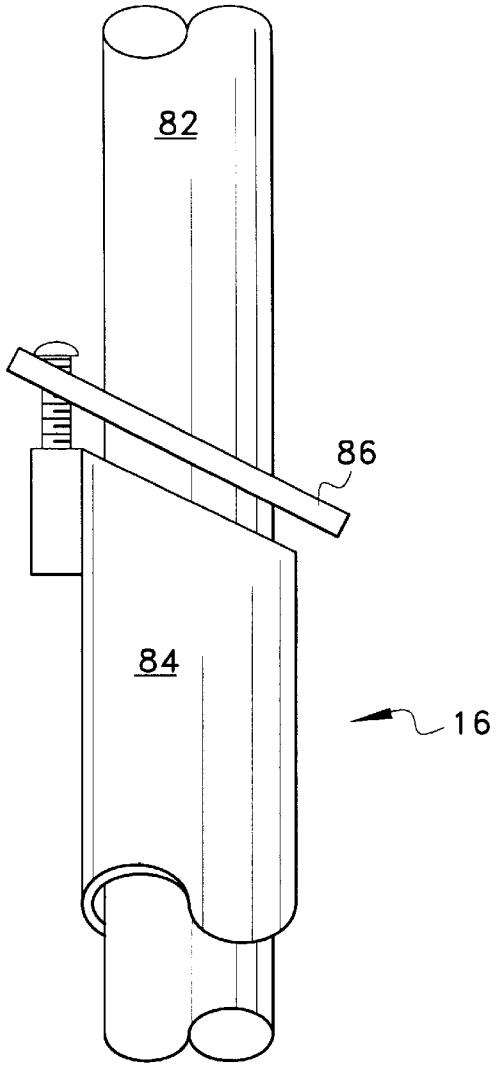
FIG. 7B is a sectional side view of a first embodiment of a telescoping support pole, showing the locking mechanism in the locked position.

The telescoping pole 16 may be any type having an infinite number of settings within its range of adjustment. One example is illustrated in FIGS. 7A–7B. The telescoping pole 16 includes an inner shaft 82 and outer shaft 84. The inner shaft 82 is illustrated as the upper member, but this may be reversed. A washer 86 is pivotally attached to the outer shaft 84, surrounding the inner shaft 82. When the washer 86 is perpendicular to the pole 16 (FIG. 7A), the inner shaft 82 is free to extend and retract. When the washer 86 is angled (FIG. 7B), as biased by gravity, the inner shaft 82 is frictionally held in place relative to outer shaft 84.

Figure 8A:
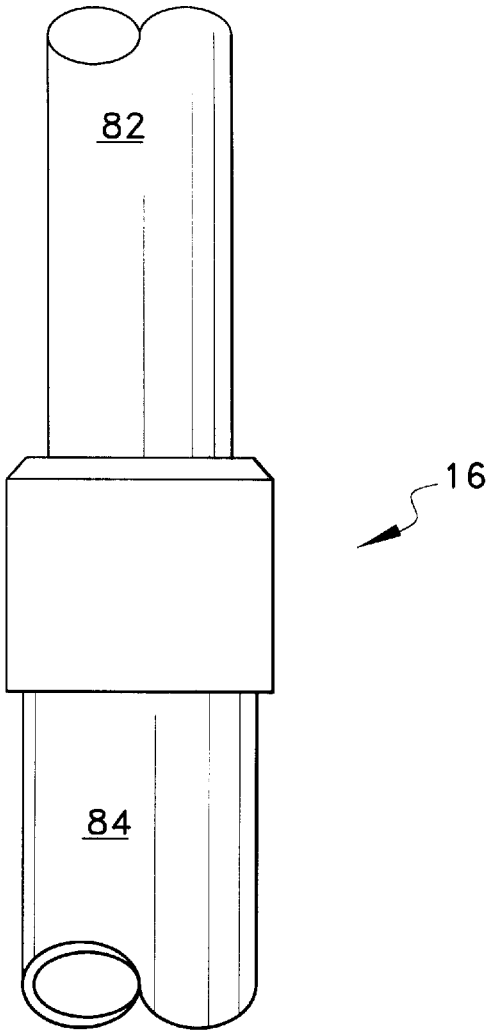
FIG. 8A is a sectional side view of a second embodiment of a telescoping support pole.
Figure 8B:
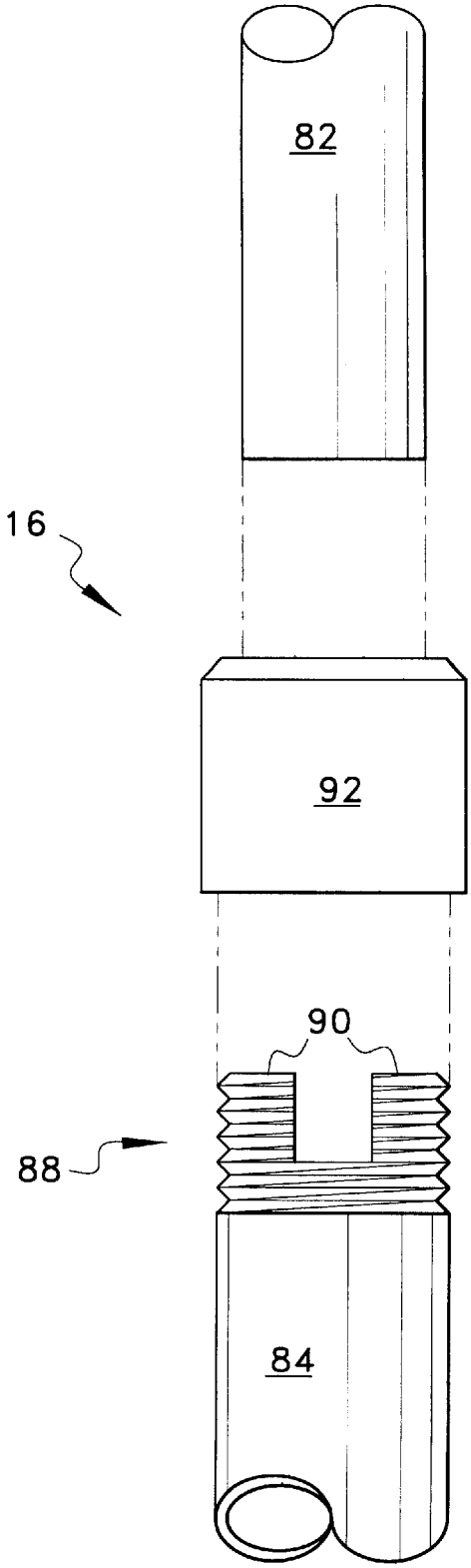
FIG. 8B is an exploded sectional side view of a second embodiment of a telescoping support pole.

A second, commercially available example of a telescoping pole 16 is illustrated in FIGS. 8A–8B. The externally threaded end 88 of outer shaft 84 is divided into a pair of opposing wings 90. An internally threaded ring 92 engages the wings 90. Loosening the ring 92 allows inner shaft 82 to extend and retract. Tightening the ring 92 pushes the wings 90 towards inner shaft 82, causing the wings 90 to frictionally abut inner shaft 82, securing the inner shaft 82 in position relative to outer shaft 84.

Figure 9:
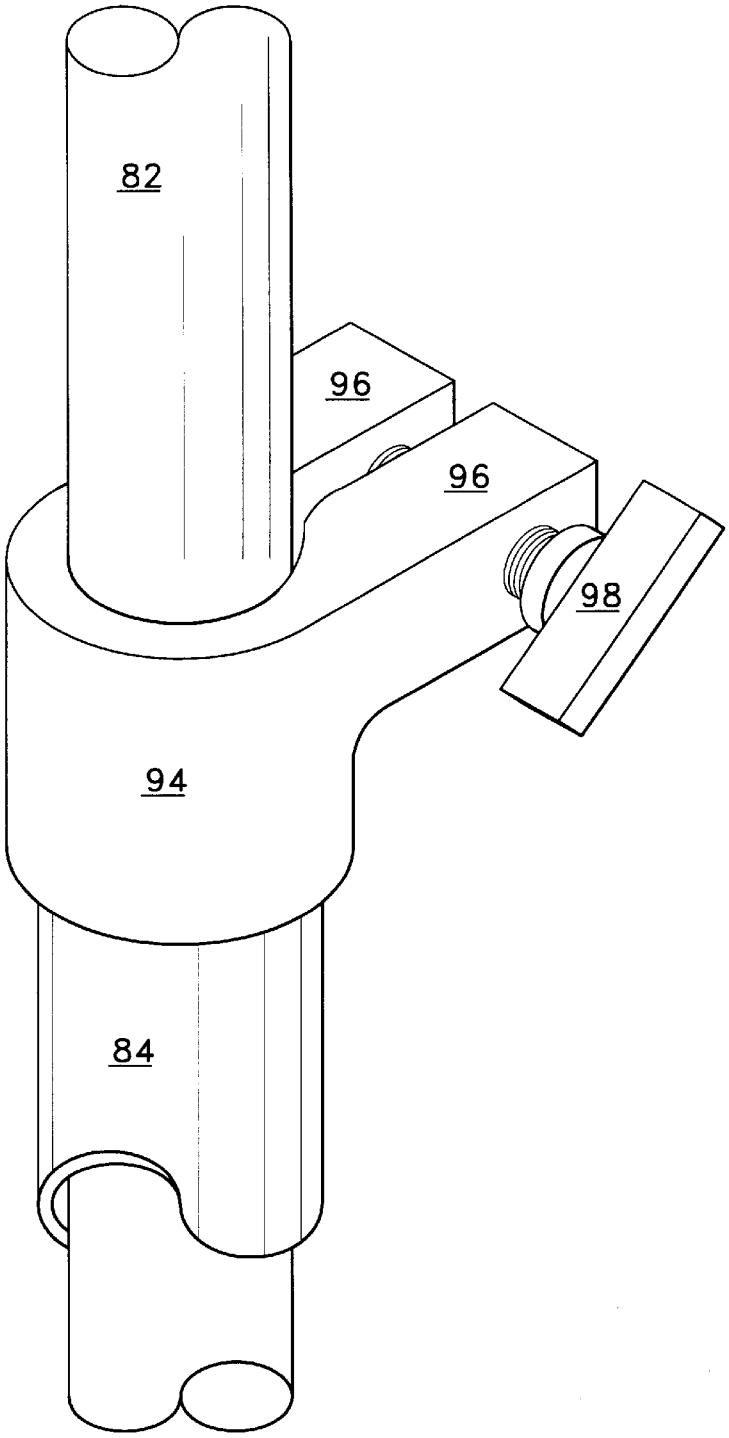
FIG. 9 is a sectional side perspective view of a third embodiment of a telescoping support pole.

FIG. 9 illustrates a third, commercially available embodiment of the telescoping pole 16. The top of the outer shaft 84 includes a split collar 94, through which the inner shaft 82 passes. The two ends 96 of the split collar 94 are joined by a threaded rod 98. Turning the threaded rod 98 in one direction allows the two ends 96 to separate, allowing the inner shaft 82 to extend and retract. Tightening the rod 98 pulls the ends 96 together, frictionally securing inner shaft 82 within the collar 94.

Figure 10:
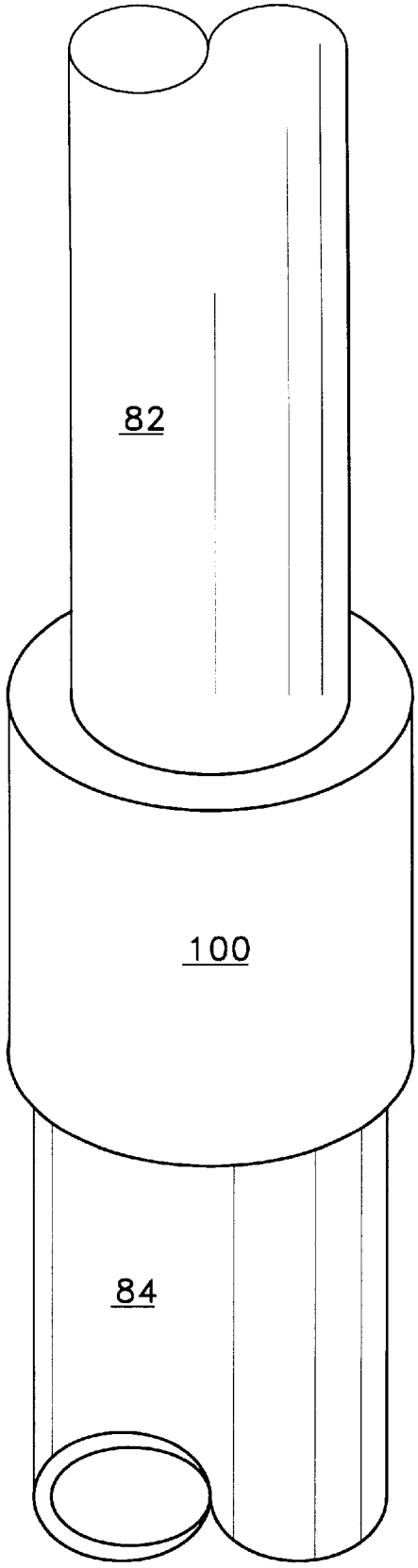
FIG. 10 is a sectional side perspective view of a fourth embodiment of a telescoping support pole.

FIG. 10 illustrates a fourth, commercially available embodiment of the telescoping pole 16. The inner shaft 82 and outer shaft 84 are secured with respect to each other by a cam locking device 100. Referring back to FIG. 2, all embodiments of the telescoping pole 16 include a flat base 102 at their lower ends.

Referring to FIGS. 1–2, the container 12 may be used with the telescoping pole 16, or held by the user 38 during use. The user first places the appropriate glove 14 over the flange 32, if the glove 14 is not already there. If vacuuming the debris from the box during cutting is desired, the user 38 removes the cap 60 from the vacuum attachment 48, and connects the vacuum hose 50 to the vacuum attachment 48, allowing the use of vacuum 58. Next, the user places the appropriate tool 56 inside the box. If the tool 56 requires electrical power, then the cap 62 is removed from the power cord aperture 52, and the cord 54 of the tool 56 is passed through the power cord aperture 52.

The seal 42 at the top of container 12 is then placed against the surface to be cut. If the telescoping pole 16 is used, the prongs 72 of the fork, 74 are inserted into the sleeves 68. Next, the user 38 orients the pole 16 vertically, places his foot on the base 102, and puts the stem 76 of the fork 74 over the top of the pole 16. Pole 16 is then extended until the seal 42 abuts the ceiling 40 or other surface to be cut. Alternatively, the user 38 merely lifts the container 12 so that the seal 42 abuts the ceiling 40 or other surface to be cut. The user then reaches into the glove 14, grabs the tool 56, and proceeds to cut the ceiling 40. Debris 36 from the cutting falls into the container 12 instead of falling on the floor.

It is to be understood that the present invention is not limited to the embodiment described above, but encompasses any and all embodiments within the scope of the following claims.

I claim:

1. A glove box for cutting a hole in a ceiling, said glove box comprising:

a rigid, transparent container including a cylindrical wall having an open top;

a resilient seal extending around said open top of said container; and a closed bottom having an aperture for receiving a person's hand, wrist, and forearm therethrough;

a glove, said glove being sufficiently long to allow a user to reach anywhere around said top of said transparent container; and means for attaching said glove around said aperture.

2. The glove box according to claim 1, said means for attaching said glove around said aperture includes a ring extending upward from said aperture into said container, said ring having a top edge including an outwardly extending flange.

3. The glove box according to claim 1, wherein said seal extends a predetermined distance above said open top of said container.

4. The glove box according to claim 1, wherein said seal further including a clip for securing said seal to said top of said container.

5. The glove box according to claim 1, further comprising a vacuum attachment aperture, said vacuum attachment aperture being dimensioned and configured to receive a vacuum hose.

6. The glove box according to claim 5, further comprising a cap for closing said vacuum attachment aperture.

7. The glove box according to claim 1, further comprising a power cord aperture, said power cord aperture being dimensioned and configured to receive the electric power cord.

8. The glove box according to claim 7, wherein said power cord aperture includes a resilient seal.

9. The glove box according to claim 7, further comprising a cap for closing said power cord aperture.

10. The glove box according to claim 1, further comprising a pair of sleeves diametrically disposed on cylindrical wall of said container, said sleeves having vertically extending hollow interior portions.

11. The glove box according to claim 10, wherein said fork further comprises a hollow stem, said hollow stem being dimensioned and configured to receive a top end of a pole.

12. The glove box according to claim 11, further comprising a pole, said pole having a flat base and a top end; and said fork includes a hollow stem, wherein said hollow stem being dimensioned and configured to receive said top end of said pole.

13. The glove box according to claim 12, further comprising a spring disposed within said hollow stem; whereby said spring vertically biasing said fork.

14. The glove box according to claim 12, further including a telescoping pole section, said telescoping pole section including an inner shaft and an outer shaft disposed between said flat base and said top end, said outer shaft having an end, and means for securing said inner and outer shafts relative to each other.

15. The glove box according to claim 14, said means for securing said inner and outer shafts relative to each other including a washer pivotally attached to said end of said outer shaft.

16. The glove box according to claim 14, said means for securing said inner and outer shafts relative to each other including a pair of externally threaded, opposing wings at said end of said outer shaft; and an internally threaded ring engaging said wings;

wherein inner shaft being relatively positioned and secured within said outer shaft by said internally threaded ring compressing said externally threaded wings at said end of said outer shaft, thereby fictionally engaging said inner shaft.

17. The glove box according to claim 14, said means for securing said inner and outer shafts relative to each other including a split collar disposed at said end of said outer shaft, said split collar having a pair of ends, each of said ends having a threaded aperture therein, said apertures being aligned for receiving a threaded rod therein, whereby said split collar being releasable compressed against said inner shaft upon turning said threaded rod, thereby fictionally holding said inner shaft relative to said outer shaft.

* * * * *